US005388861A

United States Patent [19]

Reiter

[11] Patent Number: 5,388,861

[45] Date of Patent: Feb. 14, 1995

[54] TRANSPARENT OVERLAY DEVICE FOR MAKING NOTES ON PRINTED MATERIAL

[76] Inventor: Karen Reiter, 20600 NE. 20th Pl., North Miami Beach, Fla. 33179

[21] Appl. No.: 60,179

[22] Filed: May 7, 1993

[51] Int. Cl.[6] ..... B42D 3/04; B42F 21/02

[52] U.S. Cl. ..... 281/4; 281/20; 281/42; 281/51; 283/40

[58] Field of Search ..... 281/3.1, 4, 20, 38, 281/42, 51; 283/40–43, 101, 102, 103, 105, 117; 462/17, 22, 69, 83, 901; 434/88, DIG. 34

[56] References Cited

U.S. PATENT DOCUMENTS

| | | | |
|---|---|---|---|
| 1,450,261 | 4/1923 | Robinson . | |
| 1,510,110 | 9/1924 | Schmidt . | |
| 2,510,053 | 6/1950 | Pfieffer | 281/42 |
| 2,791,040 | 5/1957 | Santorellie | 35/62 |
| 3,099,464 | 7/1963 | Smith | 281/20 |
| 3,324,823 | 6/1967 | Peters | 281/42 X |
| 3,492,743 | 2/1970 | Schmidt | 35/26 |
| 3,889,397 | 6/1975 | Flood | 35/26 |
| 4,184,699 | 1/1980 | Lowe, Jr. | 283/42 X |
| 4,670,794 | 6/1987 | Araki | 358/293 |
| 4,986,573 | 1/1991 | Brunhoefer | 283/62 |
| 5,011,191 | 4/1991 | Gannon | 283/115 |
| 5,029,899 | 7/1991 | Schieppati | 281/30 |
| 5,056,825 | 10/1991 | Templet | 283/117 X |
| 5,110,295 | 5/1992 | Concra | 434/88 |

OTHER PUBLICATIONS

3-M Post-its TM Tape Flags.

*Primary Examiner*—Peter Dungba Vo

*Attorney, Agent, or Firm*—McDermott, Will & Emery

[57] ABSTRACT

A transparent overlay device for placement over printed material wherein notations can be made on the transparent overlay device over the printed material without leaving permanent markings on the printed material is disclosed. The transparent overlay device comprises:

(a) a transparent sheet for substantially covering and protecting the printed material, the transparent sheet being capable of receiving notations thereon;

(b) attachment means for removably attaching the transparent overlay device to the printed material without damaging the printed material; and (c) a notation border attached to the transparent sheet along at least one edge of the transparent sheet, the notation border being capable of receiving notations thereon without substantially blocking any of the printed material underlying the transparent sheet.

15 Claims, 1 Drawing Sheet

TRANSPARENT OVERLAY DEVICE FOR MAKING NOTES ON PRINTED MATERIAL

FIELD OF THE INVENTION

This invention relates to devices for making notes on printed material such as books, newspapers or magazines without leaving permanent marks on the printed material. More particularly, this invention relates to transparent overlay devices which can be placed over printed material for making notations thereon.

BACKGROUND OF THE INVENTION

Frequently, it is desirable to make notes while reading printed material especially for educational or research purposes. However, if the printed material is highlighted or marked with a writing instrument such as a pen or marker, the printed material is permanently marked or damaged. For example, a student or researcher often has a need to make notes in book margins or highlight pertinent text but cannot do so without destroying the original condition of the text. Making notes or highlighting printed material is especially a problem for researchers who desire to prepare notes on ancient or rare printed materials in museum or library collections.

Transparent overlay devices have been known for some time as evidenced by U.S. Pat. Nos. 1,450,261, 1,510,110, 5,029,899 and 2,791,040. Some of these prior art devices are commonly used in association with map books and navigational charts. Other prior art devices consist of book bindings with permanently attached overlays. For example, U.S. Pat. No. 2,791,040 teaches the use of a transparent erasable pocket attached to the exterior of a map folio in which a drawing or other imprinted material can be installed, with notations made on the transparent pocket. U.S. Pat. No. 1,510,110 teaches a hinged transparent sheet attached to a map guide, and U.S. Pat. No. 1,450,261 discloses a book with tracing paper attached to the outer edge of the book cover which folds over the pages of text. U.S. Pat. No. 5,029,899 teaches a removable protective book cover which includes a jacket portion removably mountable with the binding of a book and having transparent overlay sheets secured thereto which may be placed over the pages of a book for making notations.

One problem with prior art devices is that they do not provide a convenient and easy-to-use device which can be easily placed over a page of printed material to enable notes to be made thereon. Another problem with prior art devices is that they do not enable notes to be removed or easily stored for future reference with no damage or markings being left on the original printed material.

It would therefore be advantageous to provide a device for making notes on or highlighting printed or illustrated material without leaving permanent marks on or damaging the printed material. For example, it would be advantageous to provide a device for students to write answers to math, science or other homework problems on an easily removable device rather than on the text, the book margins or a loose sheet of paper. It would be a further advantage to provide a device to enable researchers or students to highlight pertinent text and take notes on printed material which can be removed and stored for future reference without causing any damage to the printed material.

It is therefore an object of the present invention to provide a transparent overlay device for making notes on printed material without leaving permanent marks on the printed material. It is another object to provide a transparent overlay device which can be easily attached to or removed from printed material without damaging the printed material. It is yet another object to provide a transparent overlay device to which an opaque border can be removably attached. Notes may made on the opaque border, which also may be easily separated from the transparent overlay and stored for future reference. Another advantage of the invention is that it preserves books so that they may be reused, and saves paper. Other objects and advantages of the invention will be apparent from the following specification and the accompanying drawings.

SUMMARY OF THE INVENTION

The above objects are accomplished by the present invention which comprises a transparent overlay device for placement over printed material wherein notations can be made on the transparent overlay device over the printed material without leaving permanent markings on the printed material. The transparent overlay device of the invention comprises:

(a) a transparent sheet for substantially covering and protecting the printed material, the transparent sheet being capable of receiving notations thereon;

(b) attachment means for removably attaching the transparent overlay device to the printed material without damaging the printed material; and (c) a notation border attached to the transparent sheet along at least one edge of the transparent sheet, the notation border being capable of receiving notations thereon without substantially blocking any of the printed material underlying the transparent sheet.

The transparent overlay device of the invention is different from the prior art devices which do not pertain to reusable overlays that can be removably attached to underlying printed material. The prior art devices are not separable from the particular underlying printed material such as a map guide or book cover to which they relate. The transparent overlay device of the present invention solves the problem of separation from underlying printed material, thereby providing much greater flexibility, by employing removable attachment means and a wipable, reusable transparent sheet and, further, by uniquely providing an additional notation area in the form of a unique border on which notes can be made and stored apart from the underlying printed material. More particularly, the unique border may have holes along one edge and may be stored in a folder or three-ring binder commonly available from office or school supply retailers for storing notebook paper.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF THE INVENTION

As used herein, "notations" or "notes" means any written letters, numbers or text, highlighting, drawings or other markings made with a writing or other marking instrument. Such notations or notes include, for example, written words or text, numbers, letters, lines, sketches, etc.

As used herein, "printed material" means printed publications, text, data, information, illustrations, numbers, etc. which are in written or tangible form. Such printed material includes, for example, books, newspapers, magazines, charts, maps, drawings and other written, printed, illustrated or published material.

As used herein "substantially covering" and "substantially protecting" the printed material mean that the transparent sheet covers more than an insignificant portion of the printed material. In other words, the transparent sheet covers enough of the printed material so that the user is able to highlight relevant text or, by way of example in the case of maps, particular streets or locations. However, as used herein, those terms do not require that the printed material completely be covered by the transparent sheet.

As used herein "without substantially blocking any of the printed material underlying the transparent sheet" means that the printed material upon which the notes are made is able to be viewed by the user of this device.

The invention comprises a transparent overlay device which enables the user to make notations over printed material on either of two surfaces: (1) a transparent sheet and (2) a notation border attached to the transparent sheet, without marking or damaging the underlying printed material. The transparent overlay device of the invention comprises those two components plus an attachment means to removably attach the transparent overlay device to the underlying printed material.

Figure 1:
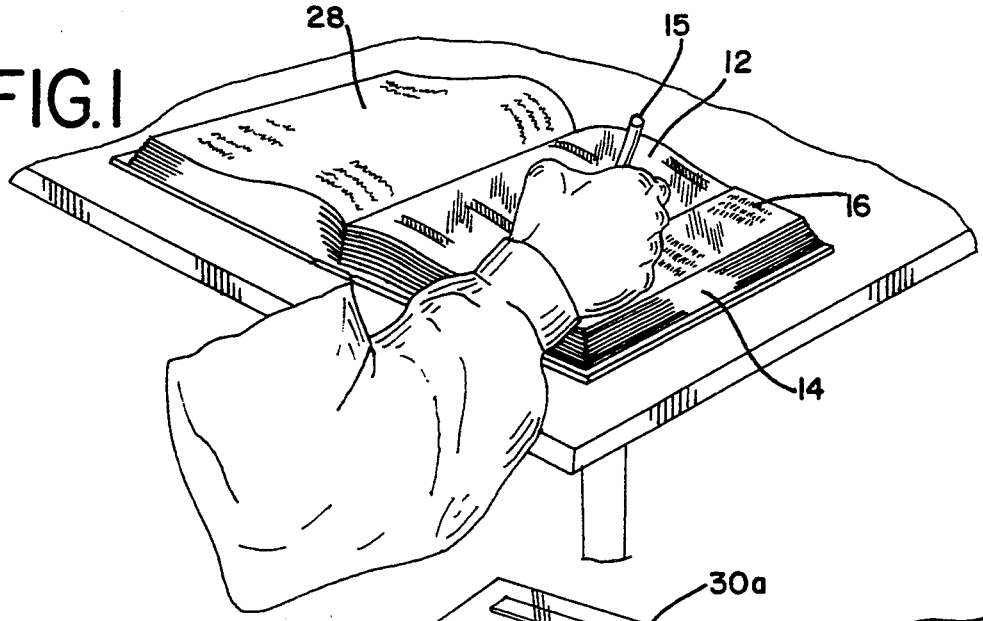
FIG. 1 is a perspective view of a transparent overlay device according to the present invention, showing the transparent overlay device in use in conjunction with a book.

Referring to the drawings, a preferred embodiment of a transparent overlay device 10 (FIGS. 1–3) comprises a transparent sheet 12 comprising a transparent or clear material for making marks thereon. Preferably, the transparent sheet 12 comprises a wipable, cleanable or erasable and reusable material for making and removing marks or notes thereon. Most preferably, the transparent sheet 12 comprises a clear plastic material selected from the group consisting of acrylics, acetates or polyesters.

After positioning the transparent overlay device 10 upon a substantial portion of the underlying printed or illustrated material 14, e.g., a full or substantial portion of a page of a textbook or a section of a map, a pen or other writing instrument 15 may be used to inscribe relevant notes, highlighting or other information including tracings on the transparent sheet 12. After the information on the transparent sheet 12 is no longer necessary, the transparent sheet 12 may be removed and cleaned by wiping or, if necessary, with water, alcohol or other appropriate solvent depending on the writing instrument used, and then reused with other pages of printed material.

The transparent sheet 12 is placed over the underlying printed material such as a book 14 and may be in a variety of sizes corresponding to a variety of sizes of printed material. For example, in a preferred embodiment, the transparent sheet 12 comprises a width in the range of about four inches to about ten inches and a length in the range of about seven inches to about fourteen inches. However, size is not critical so long as the transparent overlay device 10 will substantially cover and protect the underlying printed material 14, while enabling the printed material 14 to be substantially viewed through the transparent sheet 12. It should therefore be understood that the transparent overlay device 10 of the invention can be manufactured in many different lengths and widths to accommodate various sizes of printed material to which the transparent overlay device would be commonly applied. For example, the transparent overlay device 10 of the invention would be optimally manufactured in sizes to substantially cover and protect pages of library books, school and other textbooks and magazines.

Most preferably the transparent sheet is about eight and one-half inches (8.5") by eleven inches (11") in size and about two to three millimeters in thickness. The size and thickness of the transparent sheet 12 may vary, of course, in conformance with the size of the respective printed material sheet 14 (FIG. 1) used in conjunction with this invention.

The transparent overlay device 10 further comprises a notation border 16 attached to the transparent sheet 12 by any convenient means such as by adhesive portion 18 applied along one edge of the notation border 16. In a preferred embodiment, the adhesive portion 18 comprises a removable, medium-tack adhesive, which is well known to those skilled in the art, so that the notation border 16 can be removed from the transparent sheet 12 and replaced with a new border 16; the adhesive portion 18 has a protective liner which is removed or peeled off in order to attach the notation border 16 to the transparent sheet 12.

The notation border 16 can be made of any suitable material for making notes for storage or later reference, which are well known in the art. Examples of such materials include opaque or partially opaque paper, film-like papers, plastics or lightweight fabric sheets. Preferably, the notation border 16 comprises a matte finish polyester drafting film which is two to three millimeters in thickness.

The notation border 16 preferably comprises a width of between about two and about four inches and a length of between about seven and about fourteen inches. Of course, it is preferred that the length of the notation border 16 correspond to the length of the transparent sheet 12 to which it is attached, but this is not required. Most preferably, the notation border 16 is about three inches in width and about eleven inches in length and is attached lengthwise to a transparent sheet 12 of the same length. Also, most preferably, the notation border 16 attaches to the transparent sheet 12 by contacting the bottom side of the transparent sheet 12 by approximately 0.25 to 1.0 inches so that a perforated fold and tear line 20 is aligned with the edge of the transparent sheet 12.

The notation border 16 preferably comprises on one side an adhesive portion 18 which attaches to the transparent sheet 12. The adhesive portion is preferably a removable, medium-tack adhesive product, and is most preferably an adhesive supplied by the 3M Company, under product number 9425 "High-Tack/Medium-Tack Acrylic Double Coated Tape" with an adhesive carrier made of clear UPVC film over which lies a protective paper release liner. However, other adhesives may be used including any commercially available rubber- or acrylic-based dry, tacky, transparent adhesive. In addition to the use of double-coated tape to apply the adhesive, the adhesive may be applied in any suitable way, such as, for example spraying, rolling, etc., and may comprise any adhesive substance which remains tacky and which permits easy application and release of the notation border 16 from the transparent overlay 12. In a preferred embodiment, the notation border 16 is removed and stored after use and replaced with a new notation border 16.

The remaining portion of the notation border 16 is used for receiving notes based on information contained on the printed material 14 that underlies the transparent sheet 12. That portion of the notation border 16 may be preferably folded onto the transparent sheet 12 so that notes can be easily inscribed thereupon. To make easier the task of folding the notation border 16, the notation border preferably comprises a crease, seam or perforation 20. In a most preferred embodiment, the crease seam or perforation 20 is made by a puncture process commonly known in the art whereby approximately 72 holes per inch are made along the seam. The notation border 16 can be folded along the crease, seam or perforation 20. Additionally, the notation border is preferably selectively detachable by tearing or cutting along the perforation 20.

After cutting or tearing away the notation border 16 along perforation 20, this section of the notation border 16 may be stored for future reference preferably in a commonly available three-ring binder. Alternative storage means include folders, cases, packages, boxes, containers or any other device to store notes. In order to make this possible, the notation border 16 comprises holes 24 which are preferably approximately 0.25 inches in diameter aligned vertically along the perforation 20 of the notation border 16. In addition, an overlapping portion 26 of the notation border 16, which remains attached to the transparent sheet 12, may than be peeled off and discarded. A new notation border 16 may then be attached to the transparent sheet 12 in the same fashion as is described above, by attaching the overlapping portion 26 of the notation border 16 to the transparent sheet 12 by adhesive portion 18.

The transparent overlay device 10 can be attached to an opposite textbook page 28 by simply rotating by 180 degrees the transparent overlay device 10 and affixing the transparent overlay device 10 to said opposite page in the same manner as is described above.

While the invention is particularly suited for use with textbooks, it can be used in relation to any other type of printed material.

Figure 2:
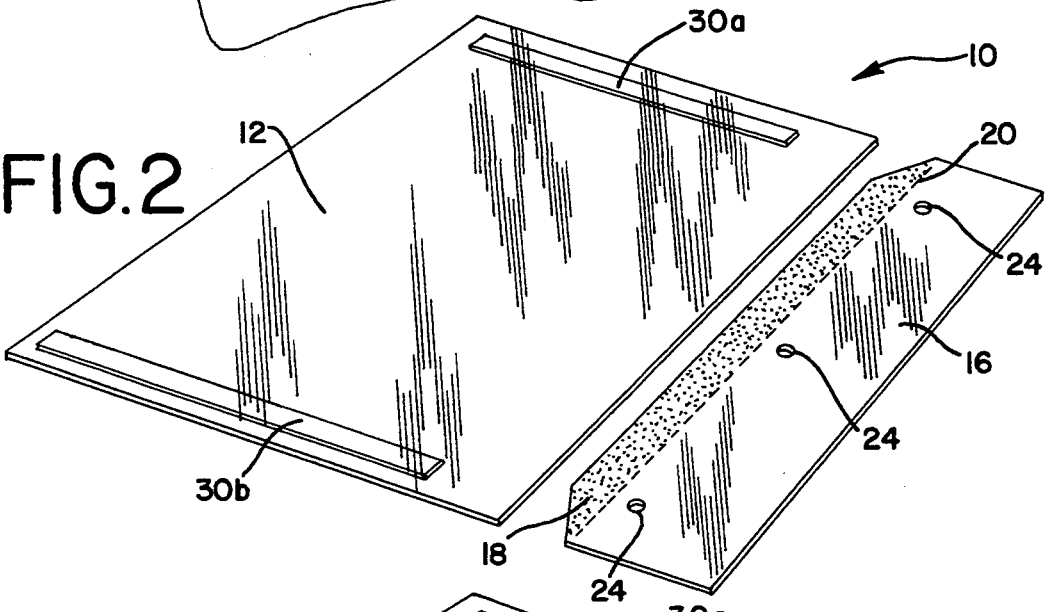
FIG. 2 is a perspective view of a preferred embodiment of the transparent overlay device of FIG. 1, with a removable notation border portion removed from a transparent sheet portion of the transparent overlay device.
Figure 3:
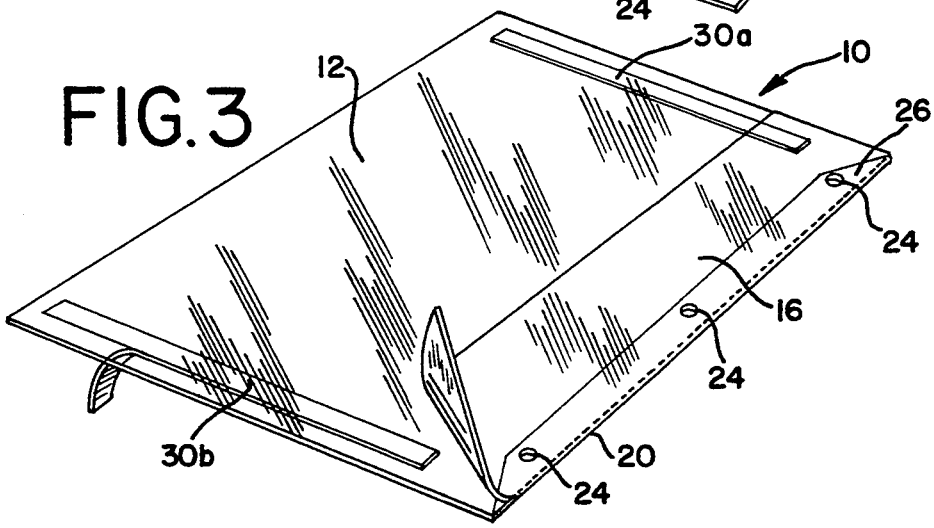
FIG. 3 is another perspective view of a preferred embodiment of the transparent overlay device of FIG. 1 showing the notation border of FIG. 2 attached to the transparent sheet and partially removed along a perforated seam.

The notation border 16 can be utilized in two forms in conjunction with the transparent sheet 12. In one form, the notation border 16 is attached to the transparent sheet at an outer edge of the transparent sheet 12, and notes are applied directly to the notation border 16 (FIG. 2, shown with the notation border 16 detached from the transparent sheet 12). In that form, the transparent sheet 12 is preferably constructed of a width which enables the edge of the notation border 16 to be approximately even with the outer edge of the underlying printed material 14. In another preferred embodiment, the notation border 16 comprises the fold or perforation line 20 so that the notation border 16 can be easily folded back over the transparent sheet 12 (FIG. 3). For example, the notation border 16 can be constructed of a width which enables folding of the notation border 16 over the transparent sheet 12 while covering only an outer margin of the printed material 14 with the notation border 16. In this manner, the notation border 16 can be provided with a more stable writing surface over the surface of the transparent sheet 12 which is, in turn, attached over the printed material 14.

In addition, in one preferred embodiment, the notation border 16 can easily be removed from the transparent sheet 12 by cutting or tearing along the edge of the transparent sheet 12 such as by tearing along perforation 20. Also, in another preferred embodiment, the notation border 16 has vertically aligned holes 24 along the lengthwise edge of the notation border 16 in order to store the removed notation border for future reference in a binder such as a three-ring binder. A new notation border 16 can then be attached to the transparent sheet 12 by removable, reusable adhesive portion 18 on the overlap portion 26. Furthermore, the transparent sheet 12 and/or the notation border 16 may be cut to conform with the dimensions of the particular underlying printed material 14.

The transparent overlay device further comprises suitable attachment means for removably attaching the transparent overlay device 10 to underlying printed material 14. Such attachment means can be any suitable means for attaching the transparent overlay device 10 to the printed material 14, so long as the transparent overlay device can be easily removed from the printed material without damaging the underlying printed material. In one preferred embodiment, the attachment means comprises at least one strip of removable, reusable adhesive **30*a*. In a most preferred embodiment, the attachment means is at least two strips of removable, reusable adhesive tape 30*a* and 30*b* located on two parallel edges of the transparent sheet 12**.

Also, most preferably, the attachment means is operatively secured to the transparent overlay device and comprises at least one one-quarter inch strip of double-coated, reusable adhesive tape. One such adhesive tape is sold by the 3M Company of Minneapolis, Minn. In a most preferred embodiment, the adhesive tape strips **30*a* and 30*b* are approximately 5" long and located along parallel edges of the transparent sheet 12. The reusable adhesive tape comprises a thin layer or coating of a suitable commercially available rubber- or acrylic-based dry, tacky, transparent adhesive. In addition to the use of double-coated tape to apply the adhesive, the adhesive may be applied in any suitable way, such as, for example spraying, rolling, etc., and may comprise any adhesive substance which remains tacky and which permits repeated application and release of the transparent overlay. In addition, in a most preferred embodiment, the surface of adhesive tape 30*a* and 30*b*** is covered by a release liner including paper or other pliable protective covering which peels off easily from the adhesive. An example of a suitable adhesive product is that supplied by the 3M Company, specifically product number 9415 "High-Tack/Low-Tack Acrylic Double Coated Tape" with an adhesive carrier of translucent white polyester film approximately 0.004" thick and a release liner made of silicone-treated paper for protecting the surface thereof. The double-coated, reusable adhesive tape also allows the transparent sheet to be removed and re-used on another page when needed.

This tape secures the transparent sheet 12 to the textbook; however, alternative methods of attaching the transparent sheet 12 to the printed material 14 include other types of tape, fasteners or other common methods of attaching material together which will not damage the underlying printed material.

The embodiment of the invention disclosed herein has been discussed for the purpose of familiarizing the reader with novel aspects of the invention. Although a preferred embodiment of the invention has been shown and described, many changes, modifications and substitutions may be made by one having ordinary skill in the art without necessarily departing from the spirit and scope of the invention.

What is claimed is:

1. A transparent overlay device for placement over a sheet having printed material thereon, wherein notations are made on said transparent overlay device over the printed material sheet without leaving permanent markings on the printed material sheet comprising:

(a) a transparent sheet for substantially covering and protecting the printed material sheet, the transparent sheet having inner and outer vertical edges and being capable of receiving notations thereon;

(b) transparent sheet attachment means for removably attaching the transparent sheet to the printed material sheet without damaging the printed material sheet; and (c) a separate notation border attached to the transparent sheet along substantially the length of the outer vertical edge of the transparent sheet, the notation border being capable of receiving notations thereon without substantially blocking any of the printed material provided on the printed material sheet underlying the transparent sheet.

2. The transparent overlay device of claim 1, wherein the transparent sheet comprises a material from which the notations are removed by wiping or cleaning the surface of the transparent sheet.

3. The transparent overlay device of claim 2 wherein the material is selected from the group consisting of acrylics, acetates or polyesters.

4. The transparent overlay device of claim 1 wherein the transparent sheet attachment means comprises at least one strip of reusable, removable adhesive placed along the outer vertical edge of the transparent overlay device.

5. The transparent overlay device of claim 4 wherein the strip of removable adhesive comprises double-sided adhesive.

6. The device of claim 5, wherein the removable adhesive is coverable by a protective release liner which peels off easily from the removable adhesive.

7. The transparent overlay device of claim 1 wherein the notation border is foldable over the transparent overlay device, without blocking the printed material.

8. The transparent overlay device of claim 1 wherein the notation border is removable from the transparent sheet.

9. The transparent overlay device of claim 8 wherein the notation border is removable from the transparent sheet by tearing along a perforated seam between the transparent sheet and the notation border.

10. The transparent overlay device of claim 1 wherein the notation border is attached to the transparent sheet by a notation border attachment means for removably attaching and reattaching the notation border to the transparent sheet.

11. The transparent overlay device of claim 10 wherein the notation border includes one or more vertically aligned holes along a lengthwise edge of the transparent sheet for storing the removed notation border in a ring binder, having rings the same distance apart, and aligned in an equivalent manner as the vertically aligned holes, the number of vertically aligned holes being equal to or greater than the number of rings in the ring binder.

12. A transparent overlay device for placement over printed material on which notations can be made on the transparent overlay sheet over the printed material sheet, without leaving permanent markings on the printed material sheet comprising:

(a) a wipable or cleanable, reusable transparent overlay sheet for substantially covering and protecting the printed material, the transparent sheet having inner and outer vertical edges and being capable of receiving removable notations thereon;

(b) transparent sheet attachment means comprising at least one strip of reusable, removable adhesive along one edge of the transparent overlay sheet for removably attaching and reattaching the transparent overlay sheet to the printed material sheet without damaging the printed material sheet; and (c) a separate notation border removably attached to the transparent sheet along substantially the length of the outer edge of the transparent sheet, the notation border being capable of receiving notations thereon without substantially blocking any of the printed materials provided on the printed material sheet underlying the transparent sheet.

13. A transparent overlay device for placement over a sheet having printed material thereon, wherein notations are made on sad transparent overlay device over the printed material sheet without leaving permanent markings on the printed material sheet comprising:

(a) a transparent sheet for substantially covering and protecting the printed material sheet, the transparent sheet being capable of receiving notations thereon;

(b) transparent sheet attachment means for removably attaching the transparent sheet to the printed material sheet without damaging the printed material sheet;

(c) a separate notation border attached to the transparent sheet along at least one edge of the transparent sheet, the notation border being capable of receiving notations thereon without substantially blocking any of the printed material provided on the printed material sheet underlying the transparent sheet; and (d) notation border attachment means comprising at least one strip of removable adhesive placed along an edge of the notation border for removably attaching and reattaching the notation border to the transparent sheet.

14. The transparent overlay device of claim 13 wherein the removable adhesive comprises an adhesive which remains tacky and permits easy application and release of the notation border from the transparent sheet.

15. The transparent overlay device of claim 13 wherein the removable adhesive is covered by a protective release liner which peels off easily from the removable adhesive.

* * * * *